United States Patent [19]

Moore et al.

[11] Patent Number: 4,526,355

[45] Date of Patent: Jul. 2, 1985

[54] ARTHROSCOPIC LEG HOLDER

[76] Inventors: Robert R. Moore, 4010 East Ave., Hayward, Calif. 94545; Steve R. Lamb, 2272 Sydney Way, Castro Valley, Calif. 94546

[21] Appl. No.: 427,498

[22] Filed: Sep. 29, 1982

[51] Int. Cl.[3] ..... A61G 13/00

[52] U.S. Cl. ..... 269/328

[58] Field of Search ..... 269/45, 76, 130, 203, 269/215, 244, 274, 328

[56] References Cited

U.S. PATENT DOCUMENTS

| | | | |
|---|---|---|---|
| 114,801 | 5/1871 | Goodchild | 269/215 |
| 4,252,306 | 2/1981 | Johnson et al. | 269/328 |
| 4,253,649 | 3/1981 | Hewson | 269/45 |

*Primary Examiner*—Frederick R. Schmidt
*Assistant Examiner*—Judy J. Hartman
*Attorney, Agent, or Firm*—Bielen and Peterson

[57] ABSTRACT

A mechanical arthroscopic leg holder for supporting and clamping a patient's leg in a desired position for examination or operation, the holder having an adjustable mounting post engageable with a standard operating table side rail holder. The mounting post supports a positioning plate and connected moveable base plate having a medial pad and a sled guide for a sliding lateral pad carriage. The sliding carriage transports an adjustable lateral pad and includes a clamping lock mechanism which permits a manually determined clamping force for controlled retention of the patient's leg in an optimized operating position with maximized patient comfort.

11 Claims, 4 Drawing Figures

ARTHROSCOPIC LEG HOLDER

BACKGROUND OF THE INVENTION

This invention relates to a mechanical device for supporting a patient's leg in an optimized position for efficient surgical operation or exploratory examination. In particular, the arthroscopic leg holder of this invention relates to a device that will retain the leg in the prepared position with a minimum discomfort to the patient prior to an arthroscopy of the knee.

Because the patient may be sedated or anesthetized, it is difficult to judge the degree of restraining force that should be applied to the patient's leg. Little or no reactionary response may be obtained from the patient in such situations. Further, even with patients who are conscious during the preparatory stages, it is difficult to assess the actual degree of discomfort due to the normal stress and anxiety generated in the environment of an operating room. Conventional systems of positioning and restraining a patient's leg may provide a satisfactory orientation of the leg, but often fail to provide that final adjustment that may prevent or inhibit local discomfort or trauma from a maladjusted support.

The arthroscopic leg holder of this invention is constructed and arranged for manual articulation to allow an operator to position a patient's leg in a desired presurgery position on the holder, to adjust the components to conform to the patient's thigh, and to firmly hand clamp the leg with a direct feel of the applied clamping force.

SUMMARY OF THE INVENTION

The arthroscopic leg holder comprises a manually adjustable surgical support and retainer for a patient's leg, particularly for arthroscopy of the knee where the thigh is rendered immobile and the lower leg is free for controlled manipulation during the surgical procedure.

Because of the wide variety of patient physiques, it is desirable that a mechanical leg holder be constructed to adapt and conform to the particular patient undergoing surgery. Additionally, the leg holder must be positionable for optimum orientation of the patient's leg for the purposes of surgery.

The multiple adjustment features of the described leg holder combine these criterial into a unit that is readily adjustable with manual and automatic locking mechanisms to firmly retain a patient's leg in a desired fixed position.

The articulatable leg holder of this invention utilizes a mounting post with a pin terminal that mounts to a standard Clark-type clamp that is coupled to an operating table accessory rail. This manner of mounting allows extension, rotation and angulation of the support post with respect to the side rail of the operating table.

The support post is rigidly connected to a positioning plate which is raised, pivoted and angled to the desired position by the single clamping lever of the standard socket clamp. The positioning plate is pivotally connected to a base plate by a pivot clamp which retains the two plates in the desired articulated position. The base plate carries the fixed medial pad and moveable lateral pad which circumferentially engage and retain the patient's thigh. The lateral pad is connected to the base plate by a pivoting and telescoping pad post that is coupled to a socket and pad lock. The socket and pad lock in turn is carried on a slidable carriage. The carriage slides in a carriage guide in a linear fashion to move the lateral pad toward or away from the fixed medial pad. The carriage includes a lever operated detent that selectively engages a detent rack on the base plate to lock the lateral pad in a desired position. The lever operated detent is quickly releasable for withdrawal of the carriage and mounted lateral pad.

By adjustment of the mounting post in the Clark-type clamp, the positioning plate can be located and fixed in the general desired position. Concurrently, the loosened base plate can be pivoted to assist in the determination of optimum position of the positioning plate. Subsequent final adjustment and tightening of the pivot clamp fixes the location of the base plate. The loosening of the pad lock allows the lateral pad and pad post to be removed from the socket of the pad lock for convenient placement of the patient's leg on the fixed medial pad. With the carriage withdrawn from the medial pad, the pad post is returned to the pad lock socket and the integral lateral pad is manually moved by the palm of the operator's hand against the patient's leg. The angle, height, displacement and force of the lateral pad against the patient's leg is directly determined by the feel of the operator as the leg is clamped between the lateral and medial pads. The detent automatically drops into the desired rack position locking the lateral displacement of the carriage and carried lateral pad. The height and angulation of the pad are fixed by tightening the lateral pad lock.

These and other features are described in greater detail in the description of the preferred embodiments.

DESCRIPTION OF THE PREFERRED EMBODIMENTS

Figure 1:
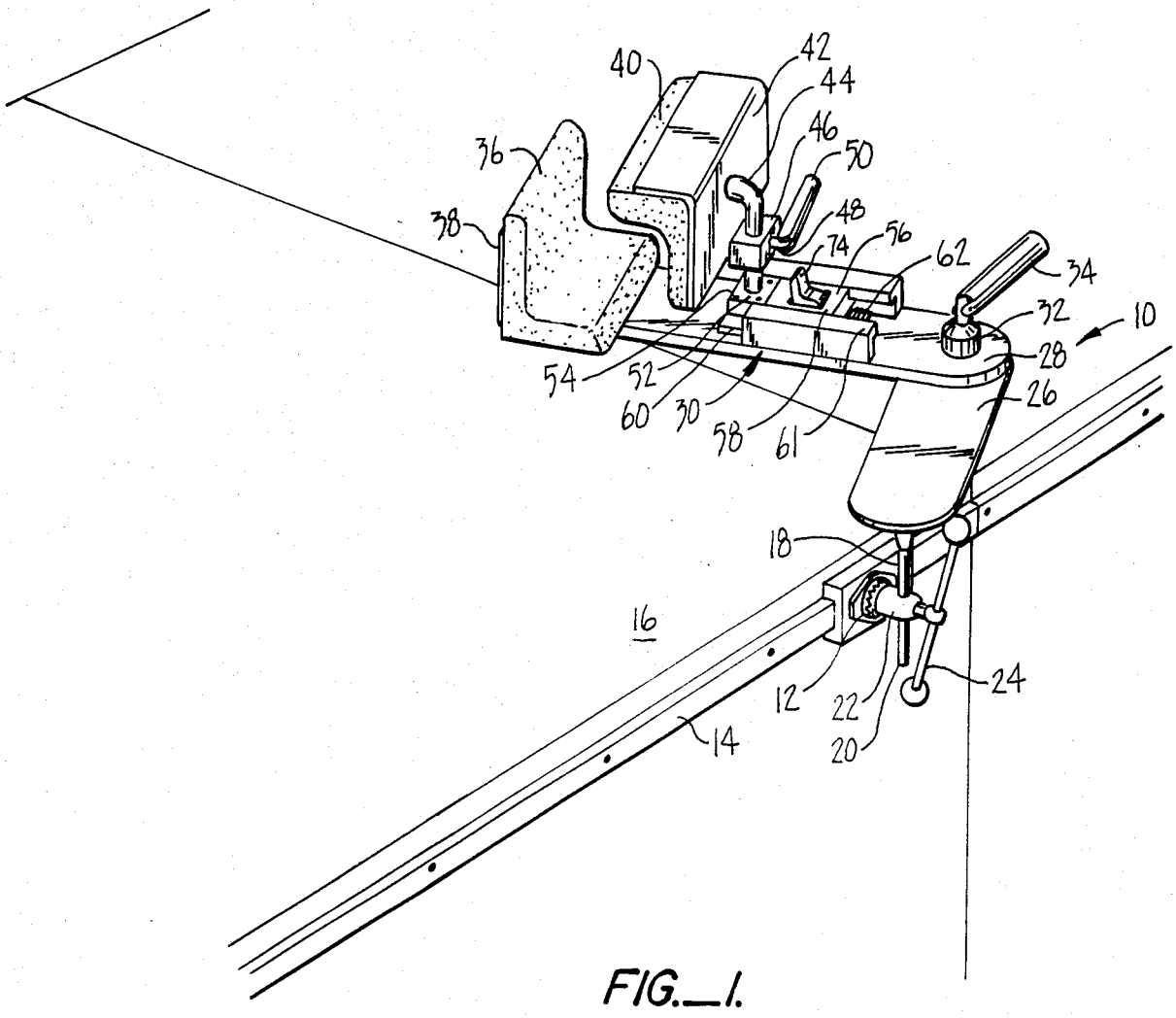
FIG. 1 is a perspective view of the arthroscopic leg holder mounted to a standard auxiliary component clamp on an operating table.

Referring to the perspective view of FIG. 1, the arthroscopic leg holder, designated generally by the reference numeral 10, is shown mounted in a standard Clark-type accessory clamp 12 coupled to a conventional accessory rail 14 of an operating table 16.

The leg holder 10 has a mounting post 18 with a terminal pin 20 which allows the post to be raised or lowered in the accessory clamp 12. The accessory clamp 12 has a cooperative locking swivel mechanism 22 which allows the post to be angularly adjusted about a horizontal axis. Rotation of the post and pin in the accessory clamp permits axial adjustment of the post about a substantially vertical axis. This adjustment can be effected prior to tightening the accessory clamp by the manual hand lever 24 which locks the post and supported components in a desired position.

The mounting post 18 is rigidly connected to a positioning plate 26 which positions and supports in cantilever fashion a base plate 28 for the leg support and retention unit 30. The base plate 28 is connected to the positioning plate by a swivel lock 32 which when loosened by manual operation of a crank lever 34, allows the base plate to articulate with respect to the positioning plate to provide an optimum positioning of the support and retention unit. When operated in conjunction with the accessory clamp, the mutual articulation permits approximately nine inches of lateral movement which facilitates use for practically any procedure.

The support and retention unit 30 comprises the components which provide the final adjustment for circumferential clamping of the patient's leg (customarily the thigh) in the position desired by the surgeon or physician. The unit 30 is constructed with a fixed medial pad 36 located at the distal end of the base plate 28 for transverse support and location of a segment of the patient's leg. The L-shaped, medial pad 36 is backed by a perpendicular end plate 38 welded to the distal edge of the base plate 28. A cooperative sliding lateral pad 40 is mounted in an L-shaped backing plate 42 supported by a curved post 44. The post is slidable and pivotally connected to a vertical socket 46 having a threaded pin lock 48 with a crank mechanism 50 to lock the lateral pad in the elevation and angular position desired. The telescoping connection of the lateral pad post 44 to the socket 46 permits removal of the lateral pad 40 from the socket support to facilitate placement of the patient's leg against the medial pad before the leg is clamped into place.

The socket 46 is fixed to a support base 52 which is screwed by machine screws 54 to a slidable carriage 56.

Figure 2:
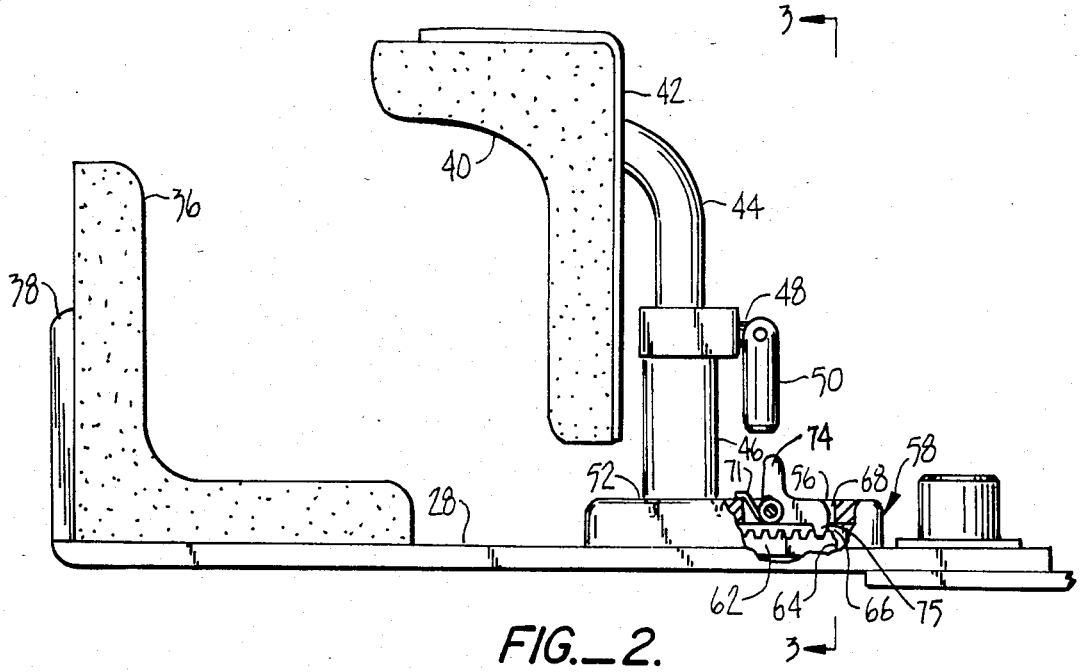
FIG. 2 is an elevational view partially fragmented of the leg holder of FIG. 1.
Figure 3:
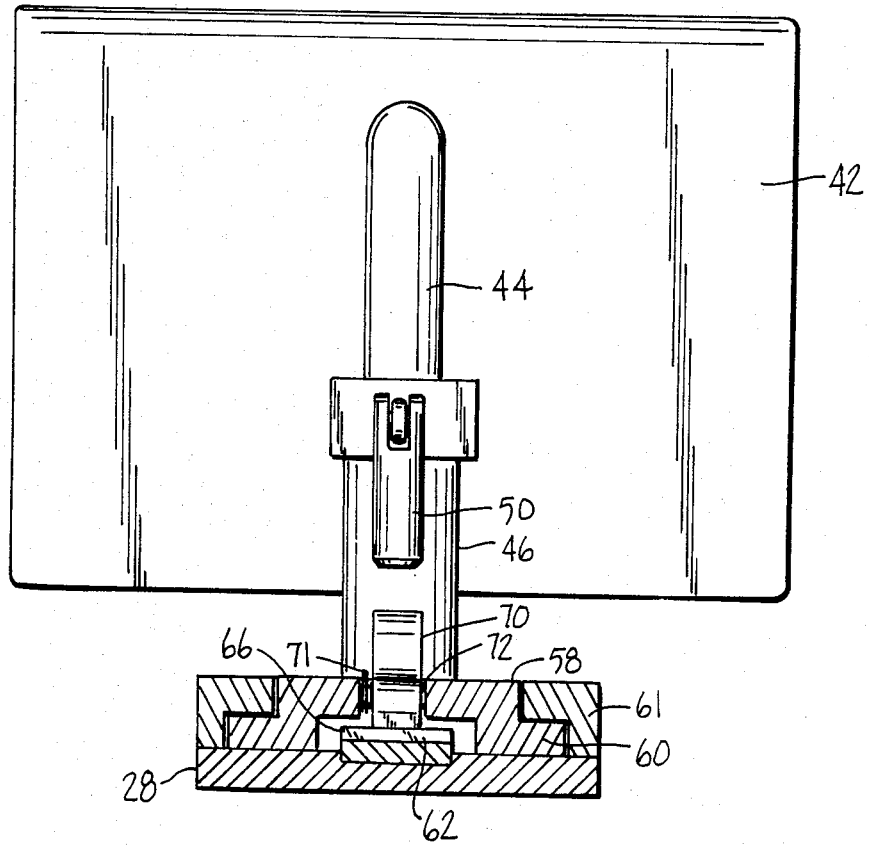
FIG. 3 is a cross sectional view taken on the lines 3—3 of FIG. 2.

As shown in FIGS. 2 and 3, the slidable carriage 56 comprises a plate-like transport member 58 with two linear, depending, flange-like skids 60. The skids 60 engage the flat surface of the base plate 28 and two parallel, carriage guides 61 which limit upward and sideward movement of the carriage. A rack 62 is mounted in an inset 64 in the base plate and includes a series of rack teeth 66 that upwardly project from the base plate. The underside of the plate-like transport member is raised from the base plate to clear the projecting rack teeth to allow the carriage to freely slide in a linear, fore and aft movement on the base plate. In a centrally located slot 68 in the transport member 58 is a pawl 70 pivotally connected to a cross pin 72 mounted at each end to opposed walls of the slot 68. The detent includes an integral release lever 74 and rack detent 75. The pawl 70 is arranged to restrict movement of the carriage away from the medial pad, without disengagement of the detent from the rack by manual operation of the lever. The pawl 70 does not restrict movement of the carriage toward the medial pad as the detent will automatically disengage a series of rack teeth as the carriage is moved and engage the rack by bias of coil spring 71, once the carriage is stopped.

The arrangement of the carriage and its locking mechanism permits the transported lateral pad to be freely moved by the palm of the operator's hand against the patient's leg supported against the medial pad. Preferably, this operation is performed with the pin lock 48 disengaged such that the lateral pad can be elevated and/or pivoted to the proper orientation to conform to the particular patient's leg. With the lateral pad firmly pressed against the leg, the pawl automatically engages. Since the adjustment forces are minimal once the clamping forces are transmitted to the pawl engaged rack, the pin lock can be easily tightened with the operator's free hand, or in most instances, after the clamping force is applied, if the other hand is otherwise occupied.

Figure 4:
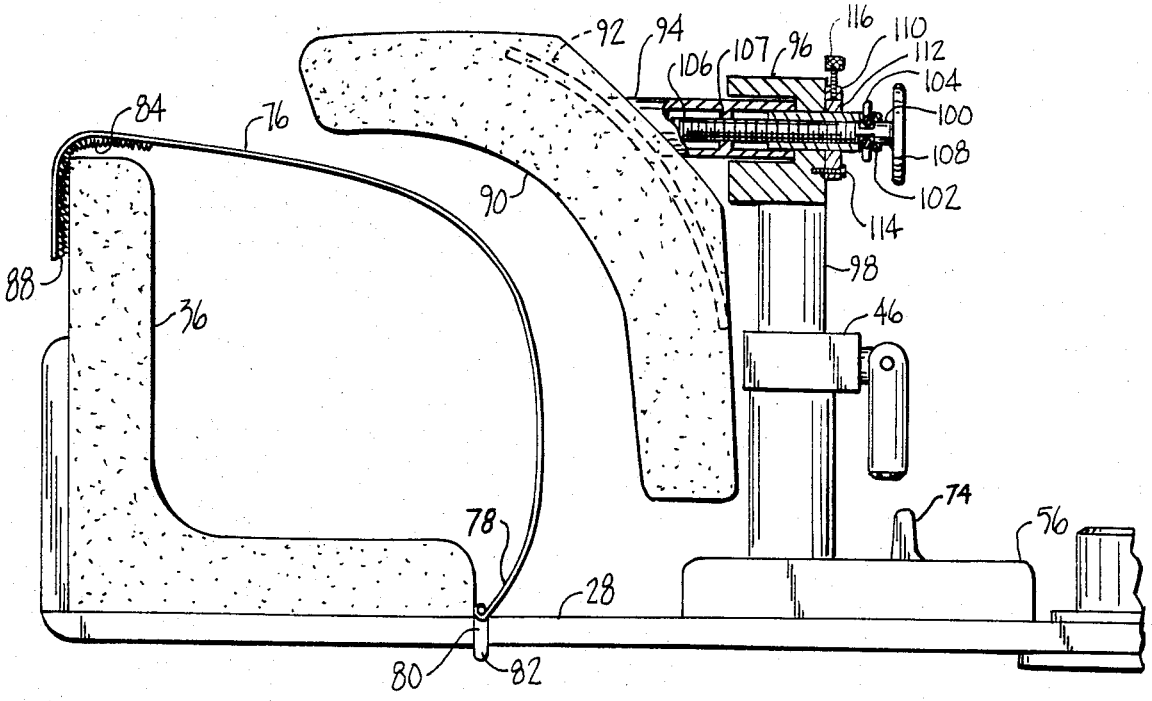
FIG. 4 is an elevational view partially fragmented of an alternate embodiment of the leg holder.

Referring to FIG. 4, an alternate embodiment of the support and retention unit portion of the leg holder is shown. While the base plate 28, and carriage 56 are the same, the pad arrangement and adjustment means are somewhat different. The medial pad 36 is the same in configuration, but includes an auxiliary flexible strap 76 the width of the pad 36. The strap 76 is connected to the base plate 28 along one edge 78 by a wire clip bracket 80, which runs over the top of the base plate and has ends 82 which are turned under the plate. The opposite edge 84 has a composition pile pad 86 fastened thereto, which cooperates with a composition hook pad 88 secured to the outside top of the medial pad. The strap 76 prevents any tissue pinching which may be occasioned by the clamping action of the laterally moved lateral pad.

In the alternate embodiment, the lateral pad 90 has a mounting plate 92 molded directly into the pad. The mounting plate is welded to a horizontal support post 94 which telescopes into a socket block 96 at the end of a vertical post 98. The vertical post is mounted as before in a clamping socket 46. The socket block 96 has a fine adjustment screw 100 which is rotationally journaled in a sleeve 102 and retained by a C-clip 104. The adjusted screw has a threaded end 106 which engages a threaded plug 107 (shown in phantom) in the horizontal post for movement of the post toward and away from the medial pad on turning of the screw knob 108. The hollow horizontal post telescopes both in the socket block and on the sleeve 102.

A collar and retaining cap 110 for a semi-circular clutch shoe 112 is fastened by screws 114 to the socket block. Adjustment of a finger screw 116 regulates the pressure of the shoe against the sleeve 102 and affectively regulates the maximum force that can be applied to the patient's leg. Inadvertent over tightening of the final adjustment screw 100 will cause the sleeve to slip out of the collar and relieve the pressure of the lateral pad against the patient's leg.

Operation of the alternate embodiment is the same as the preferred embodiment with the additional steps of fastening the strap over the patient's leg before clamping the lateral pad, and, adjusting final pressure of the lateral pad after the pad is locked in position by the pawl and rack mechanism. The final screw adjustment may also be useful if during the surgical operation the lateral pad requires further tightening an operation of the knob is more convenient or more accurate than sliding the pad and carriage unit.

While on the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An arthroscopic leg holder for an operating table comprising an elongated support member with first and second ends having a mounting means connected at said first end for mounting the support member over the operating table and a first pad fixed at said second end for support of a patient's leg;

a. a slide unit having slide connection means connecting said slide unit to said support member for linear hand transport of said slide unit toward and away from said first pad, said slide unit having a second pad positioned on said slide unit with respect to said first pad wherein said first and second pads substantially circumferentially engage the patient's leg when said second pad is displaced toward said first pad, said second pad having a pad support post adjustably engageable with a locking socket, mounted to said slide unit wherein said post is telescopically and pivotally engageable in said socket for elevationally and angularly positioning said second pad with respect to said first pad; and b. locking means for locking said slide unit in a selected fixed location on said support member with a direct hand determined clamping pressure of said first and second pads against a patient's leg, wherein said locking means comprises a selective engagement means for permitting free sliding of said slide unit toward said first pad and preventing sliding of said slide unit away from said first pad, said on manual activation of said selective engagement means comprising a pawl connected to said slide unit and a rack connected to said support member, said pawl having a detent engageable with said rack, and, a release means for permitting free sliding of said slide unit away from said first pad release means.

2. The leg holder of claim 1, wherein said release means comprises a lever connected to said pawl, wherein on manipulation of said lever, said detent is disengaged from said rack.

3. The leg holder of claim 1, wherein said slide connection means connecting said slide unit to said support member comprises a slide carriage structure on said slide unit and stationary guide structure on said support member cooperatively arranged for linear reciprocal movement.

4. The leg holder of claim 1, wherein said mounting means comprises an elongated support element pivotally connected to said support member providing angular articulation about a substantially vertical axis.

5. The leg holder of claim 4, wherein said support element has coupling means for coupling said support element to an operating table.

6. The leg holder of claim 5, wherein said coupling means comprises a post structure engageable with a conventional operating table accessory holder.

7. The leg holder of claim 6 in combination with a conventional operating table accessory holder.

8. The leg holder of claim 7, wherein said accessory holder comprises an elevationally adjustable, angularly adjustable, socket-type clamp mechanism, wherein said post structure is adjustable in elevation and angular orientation about a horizontal axis.

9. An arthroscopic leg holder for an operating table comprising an elongated support member with first and second ends having a mounting means connected at said first end for mounting the support member over the operating table and a first pad fixed at said second end for support of a patient's leg;

a. a slide unit having slide connection means connecting said slide unit to said support member for linear hand transport of said slide unit toward and away from said first pad, said slide unit having a second pad positioned on said slide unit with respect to said first pad wherein said pads substantially circumferentially engage the patient's leg when said second pad is displaced toward said first pad; and wherein said second pad has a pad support comprising a post adjustably engageable with a locking member comprising a socket mounted to said slide unit, said locking member having locking means for locking said pad support in a selected position, said post being telescopically and pivotally engageable in said socket for elevationally and angularly positioning said second pad with respect to said first pad; and b. locking means for locking said slide unit in a selected fixed location on said support member with a hand determined clamping pressure of said pads against a patient's leg.

10. The leg holder of claim 9 wherein said pad support post is substantially vertically disposed, said pad support including a substantially horizontal post engageable with a horizontal adjustment mechanism for displacing the horizontal post in a horizontal direction, said horizontal adjustment mechanism being supported by said vertical post.

11. The leg holder of claim 10, wherein said horizontal adjustment mechanism includes a force limiting means for limiting the applicable force of the second pad against the patient's leg and said first pad.

* * * * *